United States Patent [19]

Kissich et al.

[11] Patent Number: 4,552,263

[45] Date of Patent: Nov. 12, 1985

[54] DRIVE ARRANGEMENT FOR THE LOADING ARMS OF A LOADING RAMP FOR HEADING MACHINES OR LONGWALL SHEARING MACHINES

[75] Inventors: Arnulf Kissich, Zeltweg; Franz Schöffmann, Leoben; Alfred Zitz; Gerhard Steinbrucker, both of Zeltweg, all of Austria

[73] Assignee: Voest-Alpine Aktiengesellschaft, Vienna, Austria

[21] Appl. No.: 504,306

[22] Filed: Jun. 14, 1983

[30] Foreign Application Priority Data

Jul. 2, 1982 [AT] Austria ..... 2576/82

[51] Int. Cl.[4] ..... B65G 65/02

[52] U.S. Cl. ..... 198/514

[58] Field of Search ..... 198/514, 515, 516, 522; 299/45, 64–67

[56] References Cited

U.S. PATENT DOCUMENTS

| | | | |
|---|---|---|---|
| 2,885,056 | 5/1959 | McElhatten | 198/514 |
| 3,620,345 | 11/1971 | Gonski | 198/516 X |
| 3,680,920 | 8/1972 | Amoroso | 198/514 X |
| 4,047,762 | 9/1977 | Bamford et al. | 198/514 X |

FOREIGN PATENT DOCUMENTS

| | | | |
|---|---|---|---|
| 239186 | 7/1960 | Austria | 299/64 |

*Primary Examiner*—Joseph E. Valenza
*Assistant Examiner*—Michael Stone
*Attorney, Agent, or Firm*—Cushman, Darby & Cushman

[57] ABSTRACT

The loading ramp (1) of a heading machine or longwall shearing machine has swivelable loading arms by means of which the cut material is removed onto a conveying means. The surface of the loading ramp (1) can be increased by outwardly swivelling of parts (2). The loading arms (5) are driven by using a pivotal point (6) on a rotary disc (7), noting that a further swivel point (12) is provided outwardly of the circle described by a rotary pivotal point (6) on the rotary disc. The loading arm (5) is guided in a shiftable manner at the swivel point (12) and sweeps when driving the rotary disc (7) over a removal area (15, 18) defined by the relative position of the pivotal point (6) and the swivel point (12). The swivel point (12) is connected with the laterally extendable part (2) and is displaced together with the laterally extendable part (2) thus varying the removal area (15, 18).

10 Claims, 4 Drawing Figures

Figure 3:
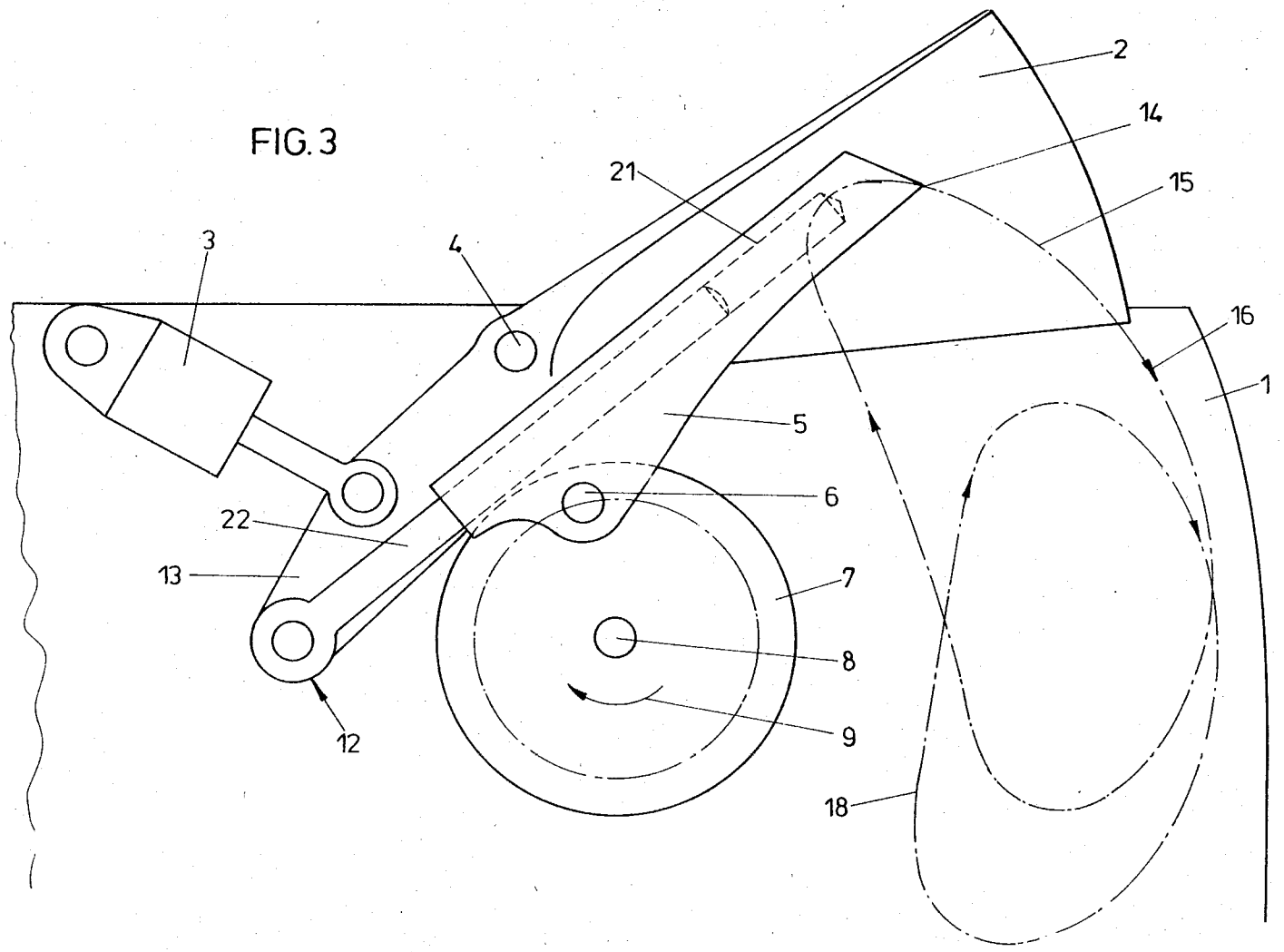

FIG. 1
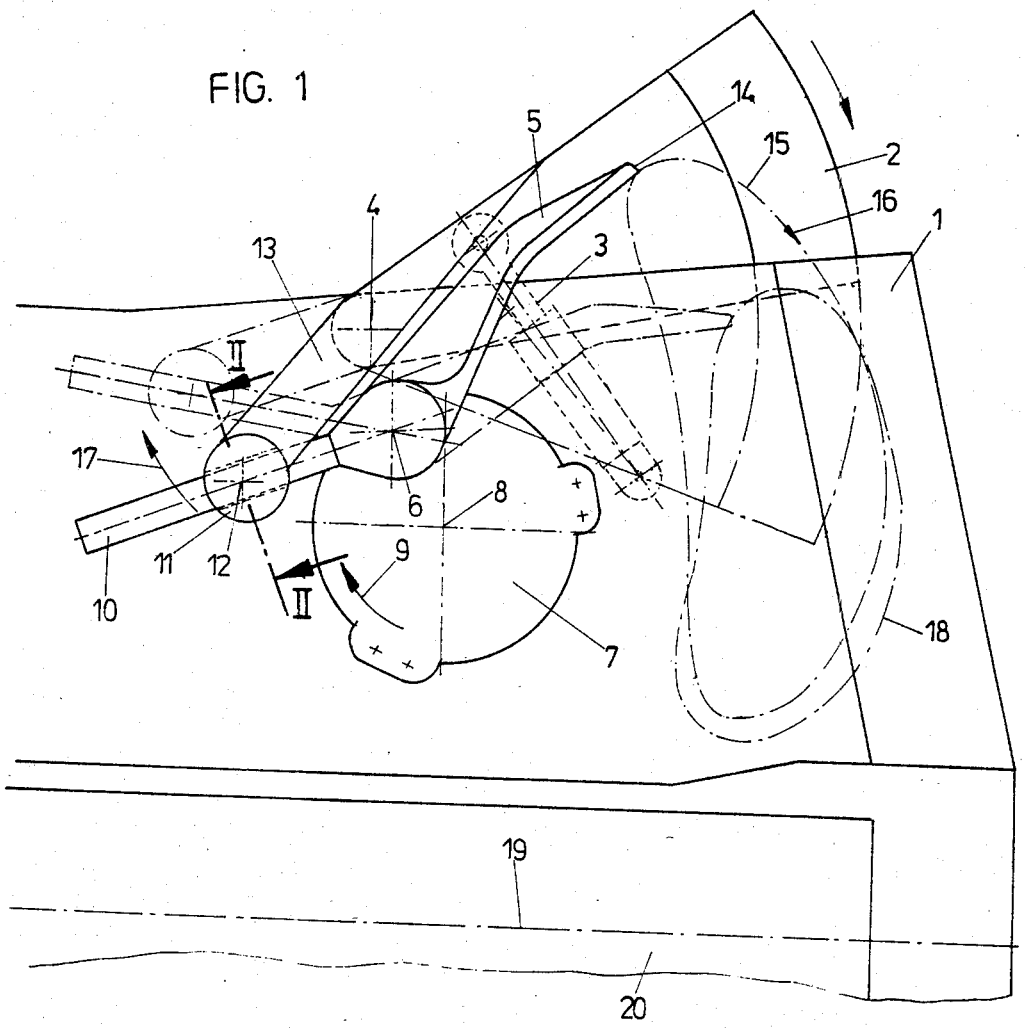
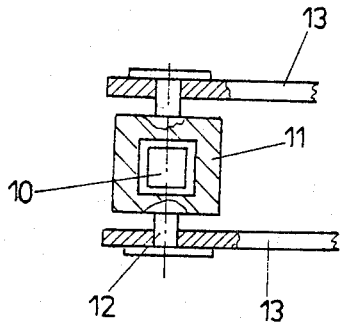
FIG. 2

DRIVE ARRANGEMENT FOR THE LOADING ARMS OF A LOADING RAMP FOR HEADING MACHINES OR LONGWALL SHEARING MACHINES

The invention refers to a drive arrangement for the loading arms of a loading ramp for heading machines or longwall shearing machines comprising laterally extendable parts for increasing the surface of the loading ramp, said loading arms sweeping over the surface of the loading ramp.

For driving the loading arms of loading ramps, which are also named lobster claws, it is necessary to select the path of movement of the ends of the loading arms in direction to the machine center or transport device, respectively, different from the path of return into the starting position so that with such a shifting movement the material to be removed is conveyed to the transport means. The ends of the loading arms or lobster claws, respectively, are thus moved along a closed curve, the path of movement in direction to the machine center being located nearer to the front end of the loading ramp than the path of return of the loading arms into their outermost lateral position. In dependence on the selection of the drive arrangement a definite curved path for the ends of the loading arms and thus a definite loading kinematics is prescribed by the bearing means and the support means of the loading arms. With these known embodiments of drive arrangements no improvement of the removal efficiency could be achieved in case of giving the loading ramp a greater width according to various known proposals, for example by means of insertable side members of the loading ramp, because the loading arms no more sweep over the enlarged area of the loading table. Any adaptation of the loading ramp to the width of the drift would thus only result in an unsatisfactory improvement of the removal efficiency.

Now, the invention aims at providing a drive arrangement of the initially mentioned type, in which the kinematics of the loading arms can be adapted to the existing width of the loading ramp for the purpose of making sure removal of material near the edge of the loading table even with a loading table having been given a greater width. For solving this task, the invention essentially consists in that each loading arm is linked to a rotary disc and is elongated beyond its pivotal point on the rotary disc by means of a guide arm being arranged for being swivelled around a swivel point located outwardly of the circle described by the rotary pivotal point on the rotary disc, the guide arm being arranged on the swivel point or on the loading arm for being shifted in its longitudinal direction, and in that the swivel point is connected with a laterally extendable part of the loading ramp in a displaceable manner and in a manner to be fixed in the selected position. By displacing the swivel points of the guide arms, the paths of movement described by the ends of the loading arms and thus the operating width or area of the loading arms can be changed, thus providing the possibility of adaptation to the existing width of of the loading ramp.

In a particularly advantageous manner, a guide means for the guide arm firmly connected to the loading arm is pivotally supported at the swivel point for pivotal movement around an axis extending in parallel relation to the axis of the rotary disc and crossing or intersecting the guide arm. In principle it is also conceivable to slidingly shift the guide arm in a crowned guide means, but with such a construction a relatively great play for the guide arm within such guide means is required what results in increased wear. By pivotally supporting the guide means, the sliding guide means for the guide arm can be given a smaller play and a more exact guiding effect can be obtained. In this case, the guide means preferably embraces the guide arm at least partially and is preferably designed as a guide bushing.

Another possibility of cooperation between the guide arm, the loading arm and the swivel point can be achieved by telesopically arranging the loading arm and the guiding arm such that the guide arm is pivotally supported at the swivel point for pivotal movement around an axis extending in parallel relation relative to the axis of the rotary disc and is slidably extending into a sliding guide such as, for example, a bore or a prismatic cavity of the loading arm. In this case, the bore or the cavity of the loading arm, respectively, is preferably closed at its end facing the receiving area of the loading ramp, the guide arm being a hollow guide arm. Such telescoping arrangement provides the advantage that the guide arm, as seen from the receiving area, terminates at the swivel point and does in operation not protrude beyond this swivel point with periodically varying length. In principle, the sliding guide can be designed as an open prismatic guide. If, however, this sliding guide is designed as a bore having a closed front end or as a prismatic cavity, no small particles of the material to be removed can enter the sliding guide, noting that in view of the guide arm being a hollow guide arm a ventilation is provided preventing the necessity to periodically compress air enclosed within the loading arm.

According to a preferred further development of the drive arrangement according to the invention, the swivel point for the guide arm is shifted in dependence on the position of the extendable parts of the loading ramp, the swivel point for the guide arm being preferably connected with a laterally extendable part of the loading ramp, particularly with a steering lever connected with the laterally extendable part. Such adjustment of the swivel points has as a result that the areas described by the tips of the loading arm are staggered and changed in its size.

In the following, the invention is further explained with reference to embodiments schematically shown in the drawing.

Figure 4:
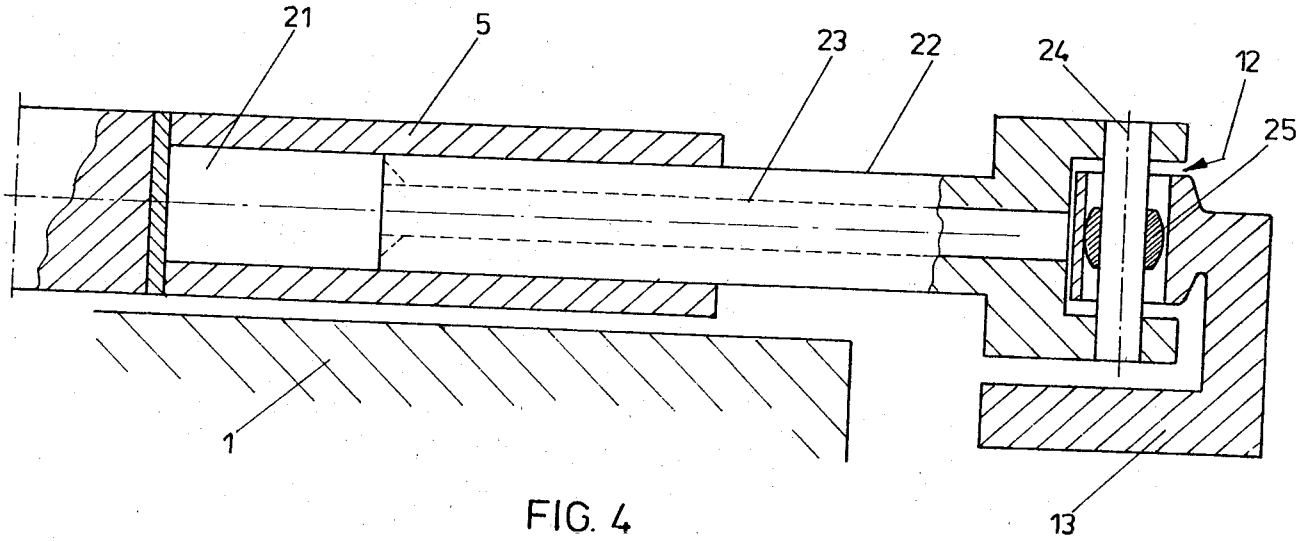

In the drawing:

FIG. 1 is a top plan view of the loading ramp comprising a first embodiment of the drive arrangement, FIG. 2 is a section along line II—II of FIG. 1, FIG. 3 is a top plan view of the loading ramp comprising a second embodiment of the drive arrangement and FIG. 4 is a vertical axial section through the respective guide arm and that section of the loading arm which cooperates with this guide arm.

In FIG. 1 there is shown a loading ramp 1 having connected thereto a laterally extendable part 2. Shifting movement of this extendable part 2 is effected by means of a hydraulic cylinder-piston-aggregate 3 linked to the rigid part 1 of the loading ramp and to the extendable part 2 of the loading ramp. The extendable or outwardly swivelable part 2 of the loading ramp 1 is pivotally linked to the rigid part 1 of the loading ramp for pivotal movement around a pivotal axis 4.

The loading arms 5 are pivotally linked to a rotary disc 7 for pivotal movement around an axis forming a pivotal point 6, the pivotal point 6 being different from the pivotal axis 8 of the rotary disc 7. The sense of rotation of the rotary disc is indicated by the arrow 9. A guide arm 10 embraced by a guide means 11 is connected with the loading arms 5 in a manner preventing relative angular movement. In this embodiment, the guide means 11 is designed as a hollow sliding block and is connected with a steering lever 13 for being pivotable around a swivel point 12 formed of an axis. This steering lever 13 is connected to the extendable part 2 of the loading ramp in a manner preventing relative angular movement.

In FIG. 1, the swivelable part 2 of the loading ramp is, in its fully outwardly swivelled position, shown with full lines. In this outwardly swivelled position, the ends 14 of the loading arms 5 describe, in direction of the arrow 16, the path 15 shown in dash-dotted lines. If the extendable part 2 is retracted by retracting the hydraulic cylinder-piston-aggregate 3, the guide means 11 is moved in direction of the arrow 17 into the position shown in dash-dotted lines. By swivelling the guide means 11, also the guide arm 10 is swivelled in direction of the arrow 17 and the curve described now by the ends 14 of the loading arms 5 is designated 18. The cleared area is thus reduced when inwardly swivelling the swivelable part 2 of the loading ramp and increased when outwardly swivelling this swivelable part 2. Movement of the loading arms is always effected from an outer position to the center 19 of the machine where a chain conveyor 20 is arranged for the removal of the material. The representation of the drawing shows only the arrangement at one of both sides of the machine. At the other side of the machine center the arrangement is mirror-inverted.

FIG. 2 shows the guide means 11 in a section. This guide means 11 is designed as a bushing having its clear opening adapted to the cross section of the guide arm 10. This cross section of the guide arm 10 can be rectangular but can also be round. The guide means 11 is pivotally supported on the steering lever 13 for being swivelled around the swivel point 12.

In the embodiment shown in FIG. 3, there is also arranged a part 2 adjoining the lateral edge of the loading ramp 1 and being swivelable around a pivotal axis 4 in outward direction by means of a hydraulic cylinder-piston-aggregate 3. Each loading arm 5 is pivotally linked to a rotary disc 7 for pivotal movement around an axis forming a pivotal point 6, said rotary disc 7 being rotatable around an axis 8 of rotation in direction of the arrow 9.

Each loading arm has an internal guide in form of a bore 21 into which a guide arm 22 extends in a slidable manner, said guide arm 22 being supported for swivelling movement around an axis parallely extending relative to the axis 8 of rotation of the rotary disc 7 at a swivel point 12 in a manner to prevent axial shifting movement. The swivel point 12 is located at the free end of a steering lever 13 connected with the outwardly swivelable part 2 in a manner preventing relative angular movement and acted upon also by the hydraulic cylinder-piston-aggregate 3.

In the outwardly swivelled position of the swivelable part 2 of the loading ramp, as is shown in the drawing, the end 14 of the loading arm 5 travels in direction of the arrow 16 along the path 15 shown in dash-dotted lines. In the inwardly swivelled position of the part 2 (which position is not shown in the drawing) obtainable by retracting the cylinder-piston-aggregate 3, the end 14 of the loading arm 5 describes the path 18.

In FIG. 4 there is shown in a vertical section a guide arrangement to be used for the embodiment according to FIG. 3. The bore 21 within this loading arm 5 is closed at its end 14 facing this loading arm. A metal seal similar to a piston ring prevents entering of dirt between guide arm and loading arm. For providing the possibility of equalization of pressure, the guide arm 22 has a longitudinal bore 23. The pivotal pin 24 at the swivel point 12 rotates in a spherical or crowned bearing bushing 25 and there is also provided an axial play so that on occasion of relative movements occurring in severe operation between the part 2 and the loading ramp 1 no dangerous vertical forces are exerted on the guide arm 22 via the swivel point 12.

What is claimed is:

1. A loading head for a mining machine of the type having a loading ramp, the ramp having laterally extendable ramp members pivotally connected to the mining machine to vary the effective width of the ramp, the loading head having at least one loading arm cooperating with the extendable ramp member, a drive means for the loading arm comprising a rotary disc, the loading arm being pivotally connected to the disc at its periphery whereby rotation of the disc causes an essentially orbital path of the loading arm, the loading arm having a guide arm extending outward from the pivotal connection between the loading arm and the disc and the guide arm being pivotally connected to the extendable ramp member whereby movement of the extendable ramp alters the position of the orbital path of the loading arm.

2. A loading head for a mining machine of the type having a loading ramp, the ramp having laterally extendable ramp members pivotally connected to the mining machine to vary the effective width of the ramp, the loading head having at least one loading arm cooperating with the extendable ramp member, a drive means for the loading arm comprising a rotary disc, the loading arm being pivotally connected to the periphery of the disc whereby rotation of the disc causes an essentially orbital path of the loading arm, the loading arm having a guide arm extending outward from the pivotal connection between the loading arm and the disc, the extendable ramp member having an arm pivotally and slidably connected to the guide arm whereby positioning the extendable ramp members alters the orbital path of the loading arm.

3. A loading head for a mining machine according to claim 1 wherein the guide arm is pivotally connected to an arm extending from the extendable ramp member such that the pivot axis is parallel to and spaced from the axis of rotation of the rotary disc.

4. A loading head according to claim 2 wherein the arm extending from the extendable ramp member is provided with a guide means for sliding movement on the guide arm.

5. A loading head according to claim 1 wherein a hydraulic cylinder arrangement is connected to the arm extending from the extendable ramp member to selectively position said ramp member.

6. A loading head according to claim 4 wherein the guide means at least partially embraces the guide arm and comprises a guide bushing.

7. A loading head for a mining machine of the type having a loading ramp, the ramp having laterally extendable ramp members pivotally connected to the mining machine to vary the effective width of the ramp, the loading head having at least one loading arm cooperating with the extendable ramp member, a drive means for the loading arm comprising a rotary disc, the loading arm being pivotally connected to the periphery of the disc whereby rotation of the disc causes an essentially orbital path of the loading arm, the loading arm having an axial bore disposed longitudinally of the loading arm and capable of slidably receiving a guide arm, the extendable ramp members having an arm pivotally connected to the guide arm whereby positioning of the extendable ramp members alters the orbital path of the loading arm.

8. A loading head as in claim 7 wherein the guide arm is hollow.

9. A loading head as in claim 7 wherein the bore is closed at its forwardmost end.

10. A loading head as in claim 7 wherein a hydraulic cylinder arrangement is pivotally connected to the arm extending from the extendable ramp member to selectively position said ramp member.

* * * * *